US006427372B1

(12) United States Patent
Howard et al.

(10) Patent No.: US 6,427,372 B1
(45) Date of Patent: Aug. 6, 2002

(54) ONE-PIECE SYNTHETIC UNDERCARRIAGE

(75) Inventors: Bradley P. Howard, Rineyville; Todd D. Cook, Ekron, both of KY (US)

(73) Assignee: RA Brands, LLC, Madison, NC (US)

( * ) Notice: Subject to any disclaimer, the term of this patent is extended or adjusted under 35 U.S.C. 154(b) by 0 days.

(21) Appl. No.: 09/781,339

(22) Filed: Feb. 12, 2001

Related U.S. Application Data

(63) Continuation-in-part of application No. 09/239,274, filed on Jan. 29, 1999, now Pat. No. 6,256,921.

(51) Int. Cl.[7] ..... F41C 23/00
(52) U.S. Cl. ..... 42/71.01; 42/75.03
(58) Field of Search ..... 42/75.03, 71.01

(56) References Cited

U.S. PATENT DOCUMENTS

| | | | | |
|---|---|---|---|---|
| 713,254 | A | 11/1902 | Thorneycroft | |
| 1,191,460 | A | 7/1916 | Pratt | |
| 1,206,234 | A | 11/1916 | Lovell | |
| 2,205,891 | A | 6/1940 | Sprenger | 18/56 |
| 2,292,351 | A | 8/1942 | Carpenter et al. | 18/56 |
| 2,439,137 | A | 4/1948 | Keller | 154/129 |
| 2,753,642 | A | 7/1956 | Sullivan | 42/71 |
| 3,011,283 | A | 12/1961 | Lunn et al. | 42/71 |
| 3,023,527 | A | 3/1962 | Leek | 42/71 |
| D219,969 | S | 2/1971 | Selnau | D22/6 |
| 3,681,181 | A | 8/1972 | Hameister et al. | 161/41 |
| 4,567,810 | A | 2/1986 | Preston | 89/142 |
| 4,674,216 | A | 6/1987 | Ruger et al. | 42/71.01 |
| 4,703,826 | A | 11/1987 | Byron | 89/188 |
| 4,850,127 | A | 7/1989 | Davis et al. | 42/71.01 |
| 5,429,034 | A | 7/1995 | Badali et al. | 89/193 |
| 5,519,954 | A | 5/1996 | Garrett | 42/6 |
| 5,615,508 | A | 4/1997 | Miller et al. | 42/71.01 |
| 6,070,354 | A | 6/2000 | Burigana et al. | 42/71.01 |

OTHER PUBLICATIONS

Close Assault Weapon System, Olin Winchester Group, Heckler & Koch Inc.
Model 11–87 autoloading shotgun parts list, Remington Arms Co., Inc. 18–20.
Nova Gun by Benelli USA Corp., American Hunter Magazine, Jan. 1999 edition.
The Modern Gunsmith, Funk & Wagnalls, 1934 p. 101–103, 109–110.

*Primary Examiner*—Michael J. Carone
*Assistant Examiner*—Michelle Thomson
(74) *Attorney, Agent, or Firm*—Womble Carlyle Sandridge & Rice, PLLC

(57) ABSTRACT

The present invention is a shotgun undercarriage, for use in conjunction with a top receiver, barrel, fire control, carrier assembly, magazine assembly, and action system. The undercarriage has an integral and unitary stock, bottom receiver, forearm and integrated bolt buffer. The stock is adaptable for housing an action spring; the bottom receiver has at least one opening for mounting the fire control, the carrier assembly and the top receiver; and the forearm has a magazine housing. The bottom receiver and forearm cooperate to form at least one mounting surface capable of receiving the barrel and the top receiver.

27 Claims, 7 Drawing Sheets

ONE-PIECE SYNTHETIC UNDERCARRIAGE

CROSS-REFERENCE TO RELATED APPLICATION

This application is a Continuation-in-Part of pending application Ser. No. 09/239,274, now U.S. Pat. No. 6,256,921 filed Jan. 29, 1999.

FIELD OF THE INVENTION

This invention generally relates to the field of firearms and more specifically relates to autoloading or semiautomatic shotguns having a one-piece synthetic undercarriage.

BACKGROUND OF THE INVENTION

Shotguns, generally, have several key component parts; namely, a butt stock, a receiver, and a forearm. These components and others combine to make the general physical model of a shotgun. Shotguns, traditionally, are comprised of a wooden or plastic butt stock, a metal receiver, and a wooden or plastic forearm.

Autoloading shotguns typically are assembled from separate machined components. The expense to machine these components, the tracking logistics of maintaining these separate components prior to assembly, and the final assembly of these components add to the overall cost of the shotgun for the consumer. The final product would be vastly improved with respect to manufacturing costs as well as dimensional accuracy if the major sub-components could be integrated into a single part. There is a need in the art for a more efficient and straightforward shotgun construction.

In order to improve performance of shotguns, particularly while hunting, innovations using synthetics were incorporated into the butt stock and forearm components. Currently, several manufacturers make synthetic butt stock and forearm components due to the preferred mechanical, chemical, and thermal properties and environmental resistance of synthetics as compared to traditional wooden components. As with outdoor sports and recreational products, resistance to the environmental elements is important. Water damage and corrosion effect the wooden components, such as the butt stock and forearm as well as the machined parts, such as the receiver and magazine. With traditional wooden components, the gun becomes scratched and scuffed or potentially more seriously damaged. Therefore, it is advantageous to manufacture shotgun components from more physically durable synthetic materials. An additional advantage of synthetic materials is a reduction in the costs of manufacturing and scrap rate.

The field of shotgun sports would be enhanced through the introduction of a simplified construction that maintains the performance characteristics of current firearms.

SUMMARY OF THE INVENTION

The present invention is a shotgun undercarriage, for use in conjunction with a top receiver, barrel, fire control, carrier assembly, magazine assembly, and action system. The undercarriage has an integral and unitary butt stock, bottom receiver and forearm. The butt stock is adaptable for housing an action spring; the bottom receiver has at least one opening for mounting the fire control, the carrier assembly and the top receiver; the bottom receiver contains an integrated bolt buffer; and the forearm has a magazine housing. The bottom receiver and forearm cooperate to form at least one mounting surface capable of receiving the barrel and the top receiver.

The present invention also relates to a shotgun comprising a unitary undercarriage that has a butt stock, a bottom receiver, and a forearm. The butt stock has a forward end and a rearward end and contains an axially extending action tube. The bottom receiver has a forward end and a rearward end that is formed integral and unitary with the forward end of the butt stock. The bottom receiver also has a bottom and two parallel and opposing longitudinally extending sides that each have a longitudinally extending recess. The bottom receiver also has a lip extending forwardly from the upper surface of the rearward end of the bottom receiver. Continuing rearward from the lip, the bottom receiver also has an integrated buffer extending outwardly from the interior upper surface of the rearward end of the bottom receiver. The integrated buffer is formed integral and unitary to the rearward end of the bottom receiver and extends vertically from the upper surface of the rearward end of the bottom receiver toward the bottom surface of the bottom receiver. The forearm has a forward end and a rearward end that is formed integral and unitary with the forward end of the bottom receiver. The forearm contains an axially extending magazine tube. The forearm has a top surface that defines a channel and also has a guide ring pocket formed in the forward end. A barrel with a rearward end and a forward end has a guide ring attached mesial to the rearward end and forward end. The barrel seats within the channel of the forearm and the guide ring rests within the guide ring pocket of the forearm. A top receiver with a rearward end and a forward end has its forward end in contact with the rearward end of the barrel. The attachment of the top receiver to the barrel can be accomplished in any sufficient manner including a threaded connection or a press fit connection. The top receiver further includes a bottom surface that is stepped downwardly from the top receiver to define opposing longitudinally extending shoulders along each underside of the top receiver. The shoulders seat within the longitudinally extending recesses of the bottom receiver and also the rearward end of the top receiver engages the lip of the bottom receiver. Also, a magazine assembly should be housed within the magazine tube; a fire control assembly should be mounted within the bottom of the bottom receiver; and a carrier system should be mounted within the bottom of the bottom receiver forwardly of the fire control assembly. In conjunction with an inertia-based action system, a recoil pad attached to the rearward end of the butt stock, the undercarriage, barrel, top receiver, magazine assembly, fire control assembly, carrier system, action system, and recoil pad combine and functionally cooperate to allow the shotgun to receive, carry and fire cartridges.

These and other aspects of the present invention as disclosed herein will become apparent to those skilled in the art after a reading of the following description of the preferred embodiments when considered with the drawings. The drawings are for the purpose of describing a preferred embodiment of the invention and are not intended to limit the present invention.

DESCRIPTION OF THE PREFERRED EMBODIMENT

Figure 1:
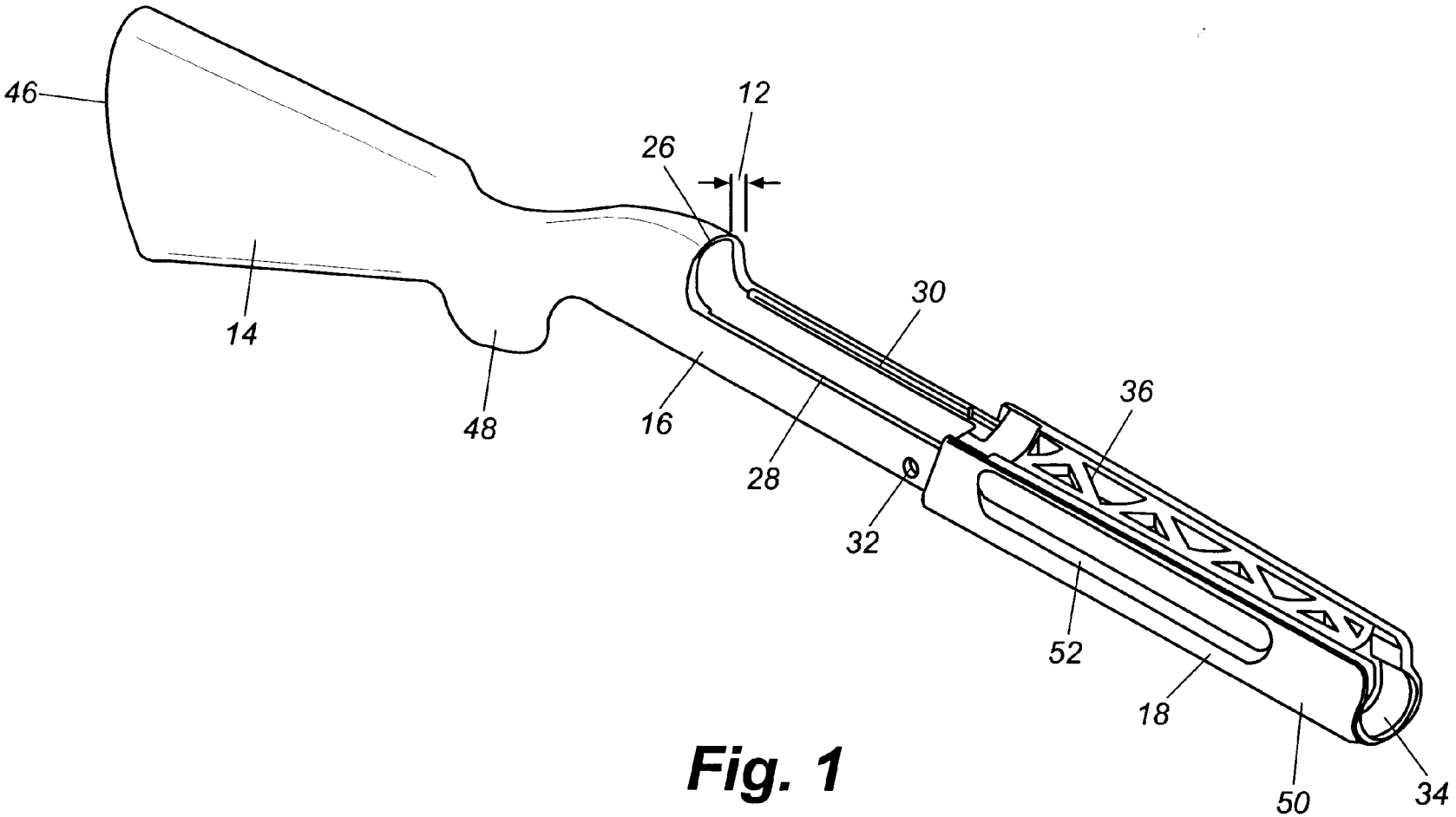
FIG. 1 is a perspective view of the one-piece undercarriage of the present invention.
Figure 2:
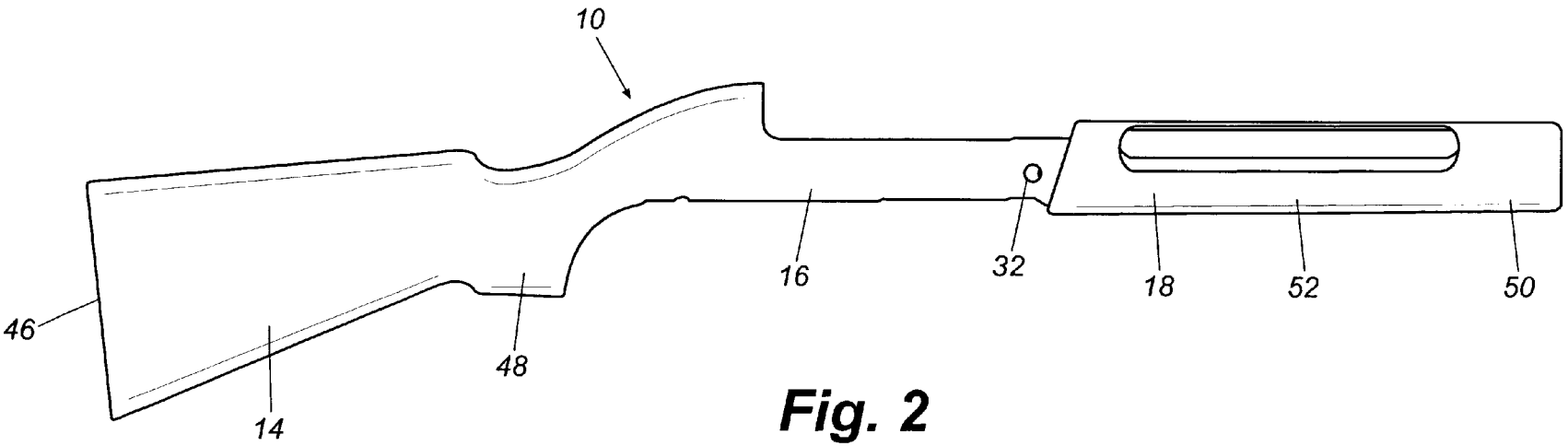
FIG. 2 is a side elevational view of the one-piece undercarriage of the present invention.

FIG. 1 illustrates the present invention, a one-piece undercarriage for shotguns, shown generally at 10. The present invention eliminates the aforementioned problems by integrally combining the butt stock, bottom receiver, integrated bolt buffer and forearm into a one-piece durable synthetic component. As used herein the term "integral" should not be interpreted to broadly encompass any means to maintain parts in a fixed relationship as a single unit. Rather, the term "integral" is used to describe the one-piece construction of the present invention. After molding, forming and shaping, the one-piece integral and unitary undercarriage of the present invention is substantially complete. The undercarriage does not use securing bolts or screws, adhesive or joints to hold the component part together. The present invention does, however, contemplate the use of multiple injection gates whereby the components of the undercarriage, including the stock, bottom receiver and forearm can be injection molded simultaneously or in separate injection stages. When the molding, shaping and forming process is complete, the resulting one-piece unitary undercarriage does not require further assembly and is incapable of disassembly in a non-destructive manner.

Preferred materials for the manufacture of the undercarriage include high strength, semi-crystalline, highly glass-reinforced thermoplastics and various thermoset materials. The specific material is chosen based upon performance characteristics. The preferred glass-reinforced thermoplastic material is approximately 20–50 percent (20–50%) glass filled polyamide nylon 6,6. As an example, and in no way limiting, the performance goals for a preferred embodiment are set forth in Table 1, below:

TABLE 1

| | | |
|---|---|---|
| Mechanical | | |
| | Stiffness | 3,000,000 psi |
| | Strength | 35,000 psi (DAM) |
| | Impact | 2.5 ft./lb. |
| Chemical | | |
| | Solvent resistance | all solvents |
| | Chemical attack | all but strong acids and bases |
| Thermal | | |
| | Softening point | above 250° F. |
| | Expansion coefficient | <0.000012"° F. (based upon 0.025" at 150° F.) |

TABLE 1-continued

| | | |
|---|---|---|
| Environmental | | |
| | UV | stabilized |
| | Oxidation | stabilized |
| | Moisture | at 50% relative humidity < 1% |

Forty percent (40%) glass-filled polyamide nylon 6,6 is one suitable material for the performance property criteria of Table 1. Other materials, such as polyamide nylon 6, polyethylene terepthalate, polybutylene terepthalate, and polyphenylene sulfide may also be used. The one-piece undercarriage of the present invention is substantially complete out of the mold and may be recycled. The associated scrap rate is reduced through the use of the preferred synthetics.

The one-piece undercarriage is preferably injection molded. Injection molding of thermoplastics as is known in the art, generally involves melting the thermoplastic, pushing the molten thermoplastic into a mold cavity, cooling the thermoplastic to a solid, and opening the mold in such a way as to be able to extract an undamaged finished form.

Preferably, the nominal wall thickness 12 of the undercarriage 10 is uniform. The preferred wall thickness 12 is approximately ¼ inches. High stress areas of the undercarriage, however, may deviate from the preferred wall thickness. A uniform wall thickness 12 will maintain a constant flow characteristic for improved aesthetic appearance, as well as improve overall stability of the shotgun. To provide uniform wall thicknesses, it is preferred that a mold gate be of appropriate size to allow the full volume of plastic to flow in and the pressure in the cavity to rise to an appropriate level before the material in the gate itself has cooled and solidified. This is accomplished most effectively using simulation codes as are used by persons skilled in the art to predict the exact moment the material at the gate reaches the solidification temperature.

Figure 5:
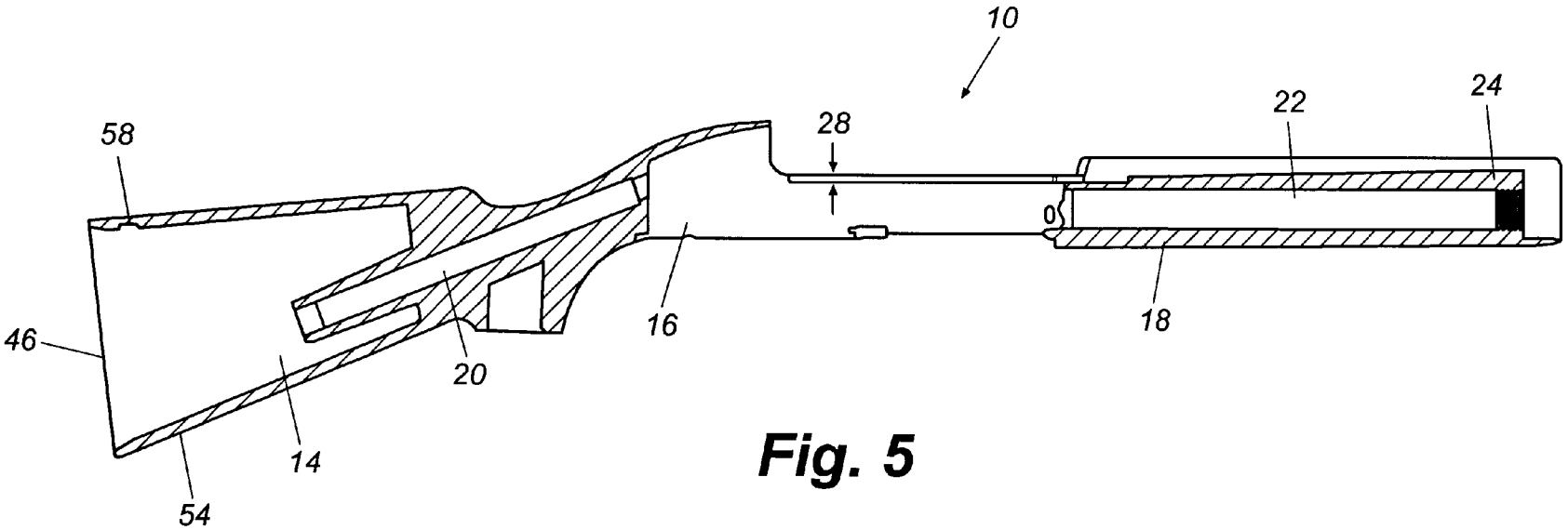
FIG. 5 is a sectional view taken along the lines 5—5 from FIG. 4.

Care should be taken with regard to the extraction of the complete undercarriage 10. To extract a complete undercarriage 10, particularly having the complex geometry as shown generally in FIG. 1, can be difficult. Some areas require mold motion in two directions simultaneously, for example notch 58 and recess 28 as shown in FIG. 5. The sequence of mold opening and the ability to control the sequence is important. As is understood by one skilled in the art, cams are used to create an undercut and should be moved and verified to be out of the way, such as with a proximity sensor or limit switch, before the mold is opened to prevent part and mold damage. Likewise, all the cores must fit filly back together before the next shot of molten plastic is introduced into the cavity. Failure to control the open and close sequence carefully will result in damaged parts or, worse yet, a damaged mold.

In addition to thermoplastics, thermosets can also be used to craft the one-piece undercarriage of the present invention. Typical thermosets that can be used include bulk molding compounds, which combine chopped glass fiber with a matrix resin, such as epoxy, vinyl ester, or unsaturated polyester. The one-piece undercarriage of the present invention can also be constructed using resin transfer molding. In resin transfer molding, a preform can be prepared with glass, carbon, or synthetic fibers, such as Kevlar™ which is placed in the cavity. The remaining space can be filled with resin, such as epoxy, vinyl ester, polyester, or other thermosetting resin. Once cured, the resulting stock would have the strength and geometric characteristics of an injection molded part.

Synthetic materials are preferred in this invention because the synthetic one-piece undercarriage requires less maintenance than traditional wooden-stocked shotguns. The synthetic composition is able to withstand harsher environmental abuse without showing signs of wear and tear. Further, exposed pins or screws that may become snagged, rusted, or stripped are minimized. As an added benefit, the color of the synthetic material is variable. For example, the customary color for synthetic stocks is black; however, a camouflage color scheme is possible. Other color schemes are also possible.

As shown in FIGS. 2–5, the undercarriage 10 replaces three major components of traditional multiple component shotgun assemblies. The undercarriage 10 has a butt stock 14, a bottom receiver 16, and a forearm 18. The current state of technology is synthetic butt stocks that do not include a receiver. Integration of the butt stock 14, the bottom receiver 16, and the forearm support 18 into a single unit 10 will represent significant cost savings for the consumer.

Figure 6:
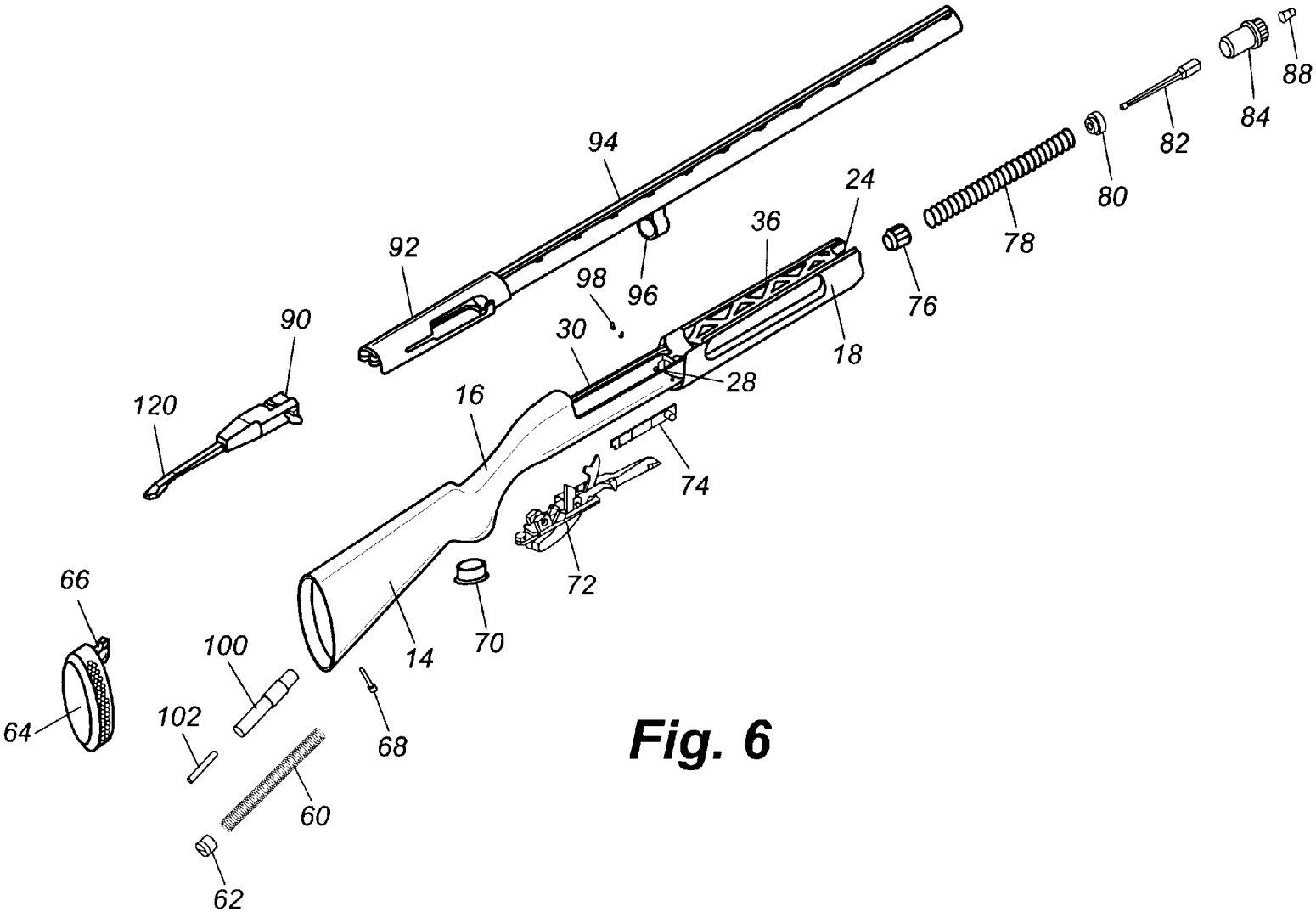
FIG. 6 is an exploded view of the one-piece undercarriage of the present invention shown with additional component parts.
Figure 7A:
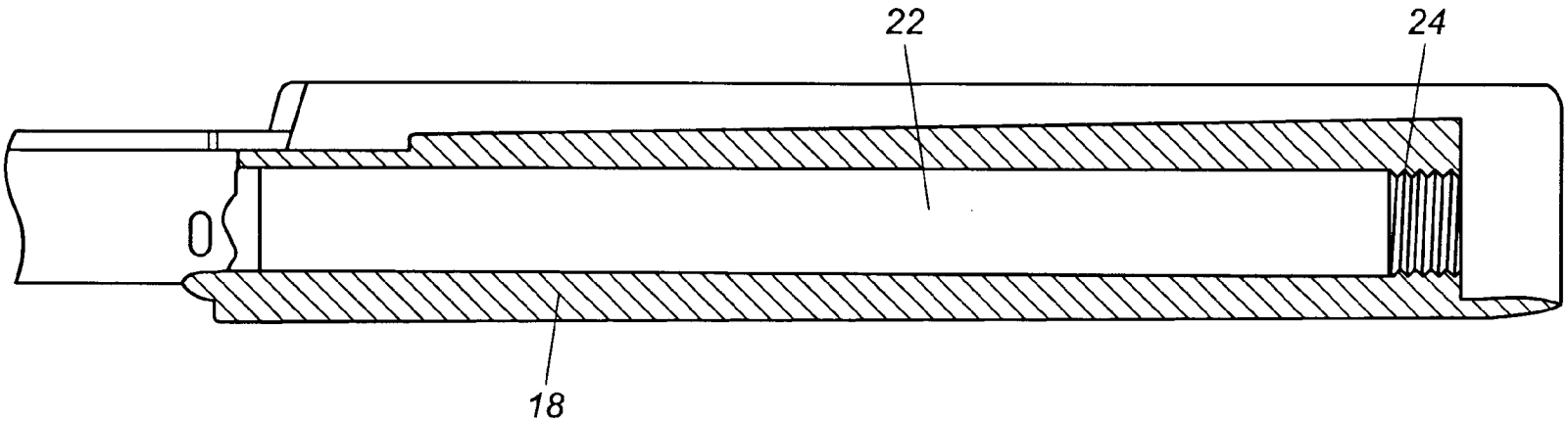
FIG. 7 is a sectional view taken along the lines 5—5 from FIG. 4 further detailing the forearm.
Figure 7B:
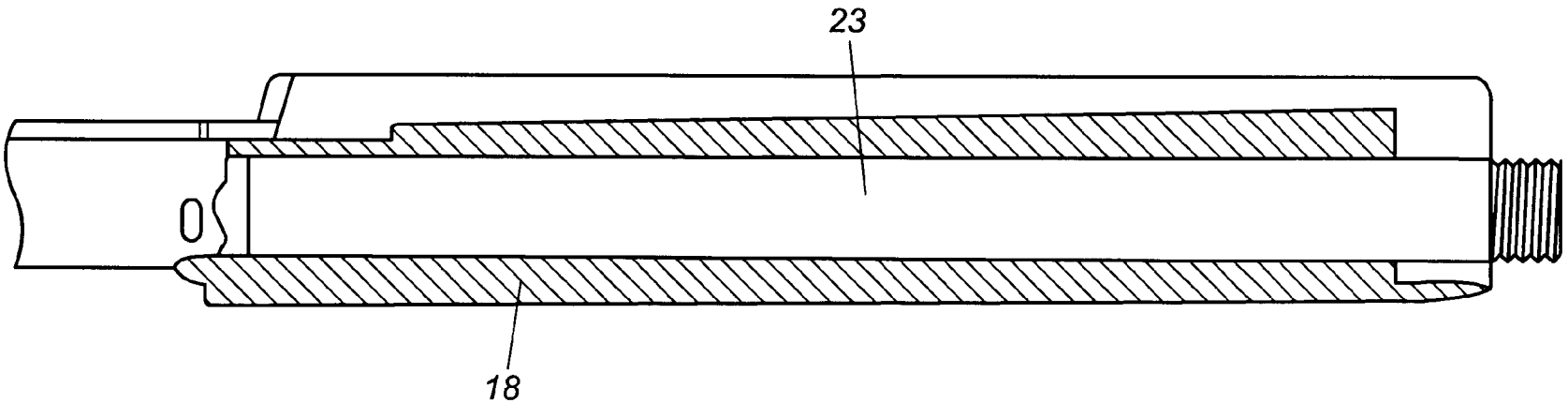
Figure 8:
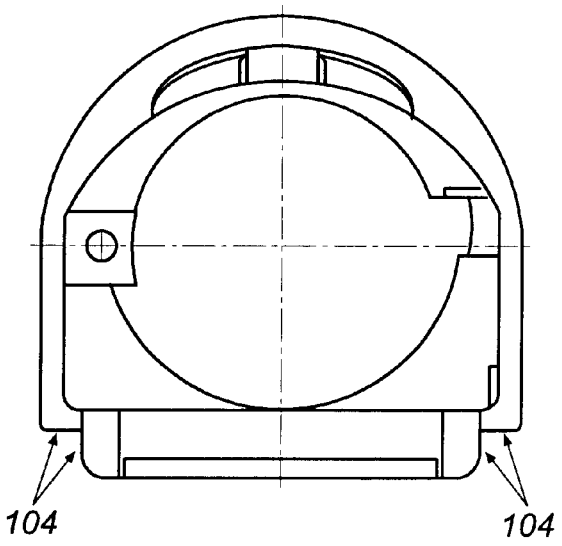
FIG. 8 is a cross-sectional view of the top receiver.

The one-piece synthetic undercarriage 10 reduces the need for machined component parts. Traditionally, forearms are constructed in a U-shape cross-section to fit over a steel magazine tube. The forearm 18, as shown in FIG. 5, is pre-formed with a hollow cylindrical housing of appropriate length and diameter for cartridge storage, known in the art as a magazine tube 22. As shown in FIG. 7, although the present invention contemplates the optional insertion of a magazine tube insert 23 within the housing, as in FIG. 7*b*, preferably, the housing itself serves as the magazine tube 22, as in FIG. 7*a*. This preferred construction eliminates the need for the traditional machined magazine tube used currently in shotguns. The preferred construction avoids the problems associated with machined magazine tubes such as lubrication, potential water damage, additional costs of machining the magazine tube and attachment misalignments during assembly. Instead, the present invention uses a single-piece undercarriage pre-molded with a magazine tube 22 within the forearm assembly 18. Also, as shown in FIG. 7*a* the magazine tube 22 preferably is formed with female threads 24, as opposed to the traditional magazine tube with male threads, as shown in FIG. 7*b*. In this manner, several component parts namely, the magazine cap, the magazine cap plug, and the cylinder collar found in conventional repeating shotguns may be replaced with a male-threaded magazine cap 84. As shown in FIGS. 5 and 6, the magazine tube with female threads 24 may receive magazine follower 76, magazine spring 78, magazine spring retainer 80, magazine plug, 82 and male-threaded magazine cap 84, with optional swing swivel 88. The magazine cutoff 98 is located at the rear of the forearm and can be used to inhibit the passage of cartridges from the magazine housing into the top receiver 92.

As shown in FIGS. 5 and 6, the butt stock 14 is pre-formed with an action spring tube 20 for housing an action spring assembly. FIG. 6 illustrates the action spring assembly to include action spring plunger 100, buffer 102, action spring 60, and plug 62. Again, the associated costs of machining a conventional action spring tube are eliminated by the present invention. The one-piece undercarriage 10, due to its combination of butt stock 14 with pre-formed action spring tube 20 and forearm assembly 18 with pre-formed magazine tube 22 also eliminates the need for re-alignment or re-assembly of the action and magazine tube 23 associated with conventional repeating shotgun assemblies.

Unlike current shotguns that have some synthetic components, the entire undercarriage 10 of the present invention is synthetic, including the bottom receiver 16. The use of synthetics reduces the costs of the overall shotgun. The one-piece undercarriage 10 of the present invention is substantially complete out of the mold. The bottom receiver 16 is formed with a lip 26. The lip 26, as shown in FIG. 1, is formed in the back of the bottom receiver 16 and prevents the top receiver 92, shown in FIG. 6, from coming out of the undercarriage 10 upon firing. As is known in the art, when a cartridge is fired from a shotgun, a moment is applied that bends the undercarriage downwardly about the center of gravity of the shotgun. The flex in a one-piece synthetic undercarriage can be greater than that observed with traditional multiple component metallic shotgun assemblies. The lip 26 on the back of the bottom receiver 16 preferably is approximately ⅛ inches to compensate for the stress moment and restrain top receiver 92 from coming out of the bottom receiver 16. Further, the bottom receiver 16 is also formed with recesses 28, 30 that extend longitudinally along the receiver.

Figure 9:
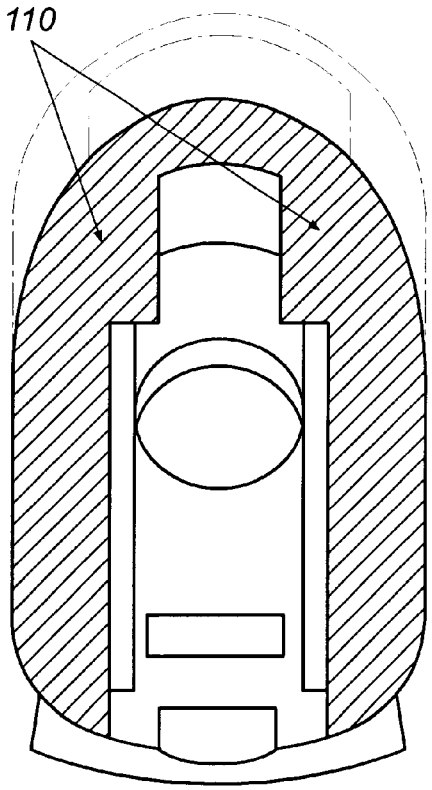
FIG. 9 is a section view through the integrated buffer.
Figure 10:
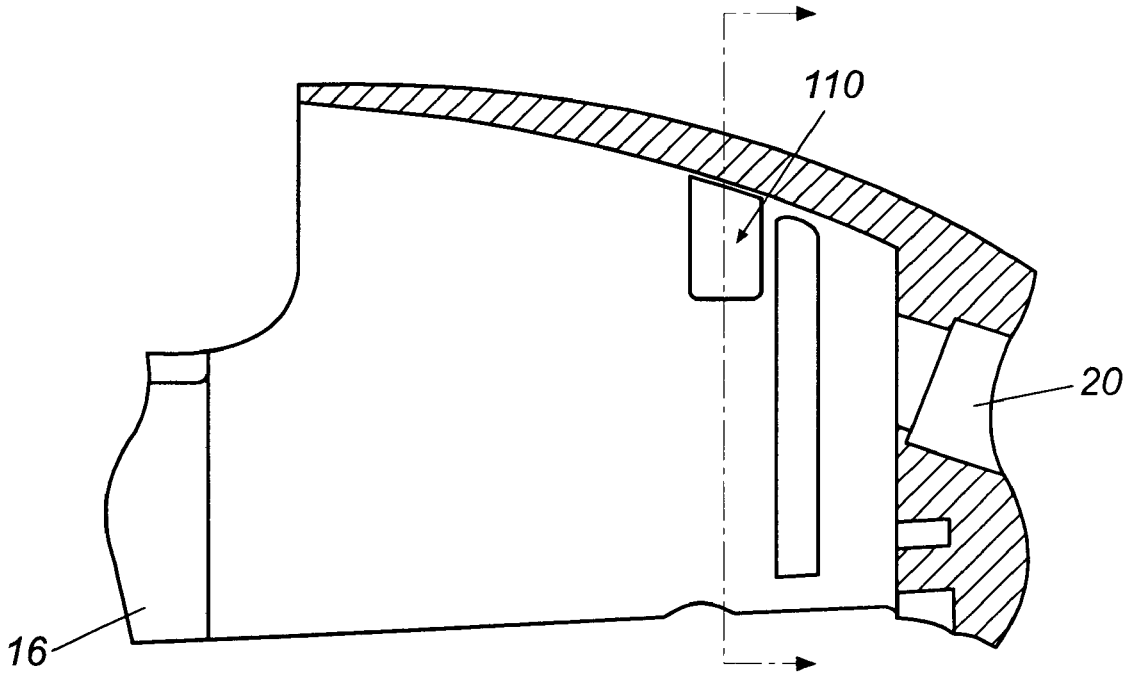
FIG. 10 is a side view of the rearward end of the bottom receiver.
Figure 11:
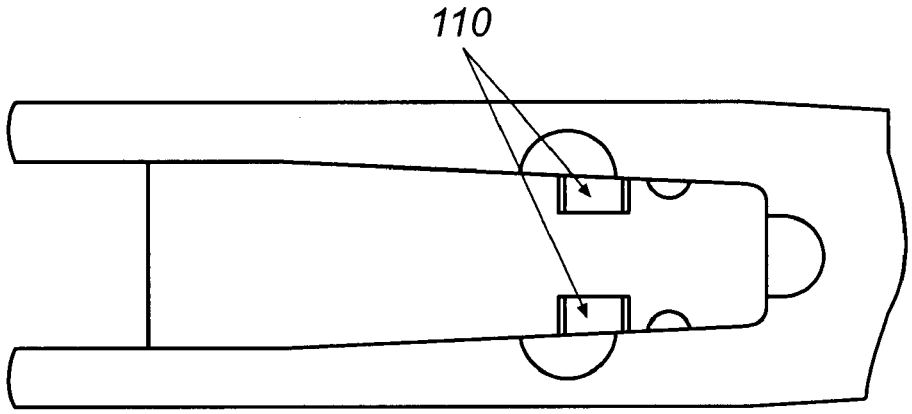
FIG. 11 is a bottom view of the rearward end of the bottom receiver.

As shown in FIGS. 9–11, the integrated bolt buffer 110 is located at the rearward portion of the bottom receiver 16 and forward of the action spring tube 20. Although the integrated bolt buffer 110 may be shaped to correspond to the specific design and dimensions of the bolt, FIGS. 9 and 10 illustrate two opposing vertical protrusions. The integrated bolt buffer 110 can be formed as two vertical protrusions and can be integrally formed flush with the upper surface and extend downward along the two inner opposing surfaces of the rearward portion of the bottom receiver. As shown in FIG. 11, the integrated bolt buffer 110 can extend outwardly from the interior walls of the rearward portion of the bottom receiver and can remain as separate protrusions. The space between the two opposing vertical protrusions can be adjusted in order to accommodate the link 120 of the bolt action assembly 90 during the firing of the shotgun. The link 120 of the bolt action assembly 90 should move freely between the integrated bolt buffer 110.

As shown in FIGS. 1, 4, 5, and 7 the recesses 28, 30 allow a better fit of the top receiver 92 within the bottom receiver 16. Not only do the recesses 28, 30 create a more aesthetically pleasing profile of the combined top receiver 92 and bottom receiver 16, but the recesses 28, 30 create a stronger, more stable construction. As stated earlier, the gun should be designed to compensate sufficiently for the stress moment that occurs upon firing. Although within the scope of the present invention, rather than laying a top receiver 92 with a solid bottom on a bottom receiver 16 with a solid top, preferably top receiver 92 is formed with shoulders 104 to fit within recesses 28, 30 to give the shotgun more stability through force distribution. The present invention contemplates adding stability by having the shoulders 104 of top receiver 92 seat within recesses 28, 30, whereby the bottom receiver 16 forms the outer surface of the conjunction. Also, however, an embodiment where the recesses 28, 30 are formed along the outer surface of the bottom receiver 16 and shoulders 104 of top receiver 92 enclose recesses 28, 30 upon conjunction is also contemplated. The top receiver 92 preferably still is machined steel to assist with proper operation of the action assembly 90, as known in the art. Also, the barrel assembly 94 preferably is a conventional shotgun barrel assembly as is known in the art. The undercarriage 10 preferably is molded with a guide ring pocket 34 due to the elimination of the machined magazine tube. In this manner, a traditional barrel may be used with the undercarriage 10 of the present invention, with guide ring 96 fitting into guide ring pocket 34.

Preferably, the entire shotgun assembly with the one-piece synthetic undercarriage 10 can have a weight from about 6 to 9 pounds, and preferably from about 7 to about 7¼ pounds. The undercarriage should be molded with reinforcing webbing 36 within the forearm to improve strength and moldability. Strength and stability are important because preferably the undercarriage is formed to receive all cartridge loads, from 2¾ light loads to 3½ heavy magnum loads.

Figure 3:
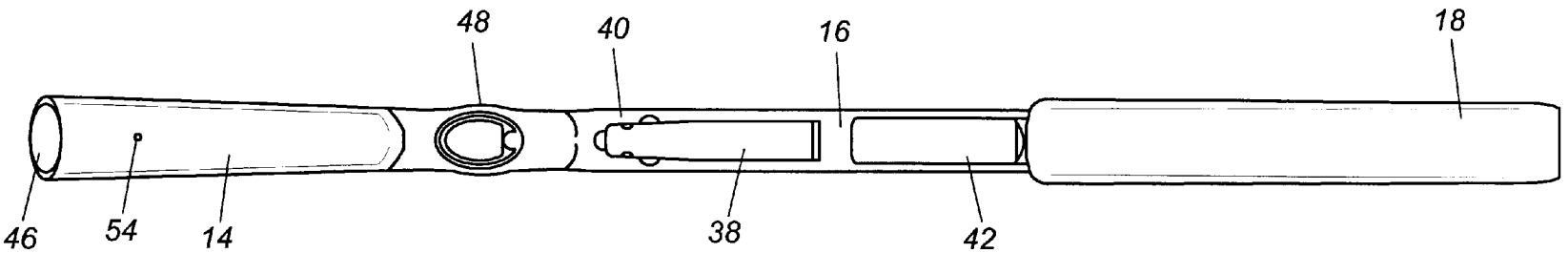
FIG. 3 is a bottom view of the one-piece undercarriage of the present invention.
Figure 4:
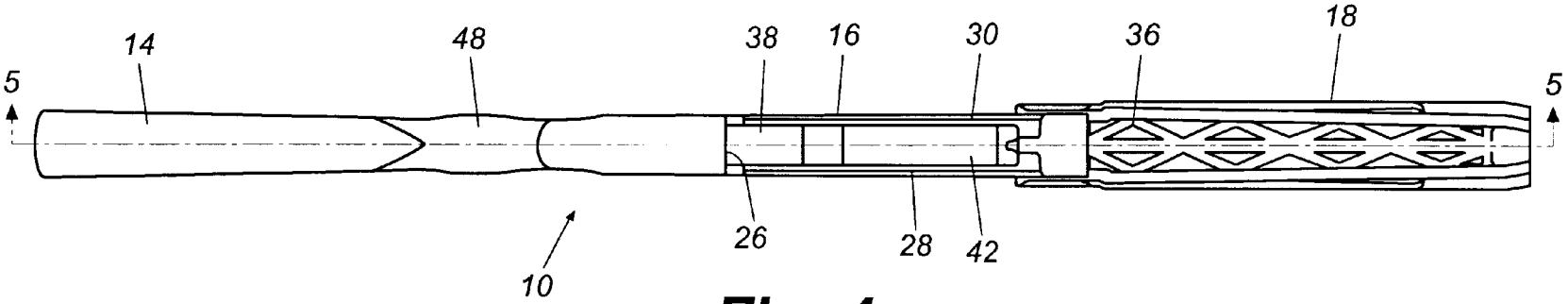
FIG. 4 is a top plan view of the one-piece undercarriage of the present invention.

As in FIG. 3, the under side of bottom receiver 16 is formed accordingly with an aperture 38 for a trigger assembly and a stop 40 to locate the fire control 72, shown in FIG. 6. A loadwell opening 42 for the carrier assembly is also formed into the undercarriage mold. As shown in FIG. 1, the undercarriage 10 should also be formed with an opening 32 for the carrier latch button. Preferably, carrier latch 74 is machined or stamped and incorporated into the bottom receiver 16.

The action system preferably is inertia-based. In other words, the system relies on the inertia from the gun recoil to cycle the action. Inertia-based actions are known in the art. Inertia-based actions require fewer component parts than gas or recoil operating systems. This is desirable because fewer parts can result in a simpler and more reliable action. Moreover, when the number of parts is minimized, the overall costs of the shotgun are reduced. The inertia-based action coordinates with the one-piece undercarriage 10 of the present invention. Gas-operated loading systems, generally, require a sealed system. Due to the materials and construction of the one-piece synthetic undercarriage 10, an inertia-based system is preferred to avoid the associated problems of maintaining the necessary seal for a gas-operated loading system. Regardless, the inertia-based loading system allows the shotgun to be manufactured at a lower cost as compared to a gas-operated shotgun. The component parts of the entire shotgun assembly at thereby kept to a minimum.

With an inertia based system, the bolt action assembly is propelled rearward after firing of the shotgun. The integrated bolt buffer 110 should be shaped and placed so that the link 120 of the bolt action assembly can slide freely rearward. Upon firing the shotgun, the link 120 of the bolt action assembly 90 pushes the action spring plunger 100 and compresses the action spring 60. As the bolt action assembly 90 nears the completion of the cycle, the action spring 60 is compressed until the action spring plunger 100 and the buffer 102 strikes the action spring assembly plug 62. In addition to the action spring assembly plug, the integrated bolt buffer 110 provides the ending position in the firing cycle. Not only does the integrated bolt buffer 110 provide the terminal position in the firing cycle but it also helps to mitigate the force that the bolt action assembly 90 imparts to the buffer 102. It should be noted that without the integrated bolt buffer 110, damage to the bottom receiver 16 would likely occur should the bolt action assembly 90 impact the rear interior surfaces when shooting heavy magnum loads.

Although not meant to limit the scope of the invention, other design features are considered by the inventors to create a preferred shotgun. For example, because the shotgun will shoot large, 3½ magnum cartridges, a large recoil or "kick" is anticipated. Therefore, the end of the butt stock can be formed with a larger footprint 46, longer and wider, to dissipate the recoil over a larger area, thereby minimizing recoil effect. For example, the butt end 46 may measure approximately 1¾ inches in width at the widest point and approximately 5¼ inches in height at the tallest point. The butt stock 14 preferably is designed to compliment a shooter's cheekbone, as is necessary for accuracy in shotgun sports. The action spring tube 20 can be angled within the butt stock to facilitate the ergonomic design of the butt stock and grip area, as is known in the art. Further, an ambidextrous palm swell 48 is added about the grip of the butt stock. The palm swell, as well, allows the shooter to grip the shotgun more securely and comfortably. Grip cap 70 may be imprinted with various designs or lettering. Lastly, the forearm 18 is formed slightly larger toward the front 50 than the middle 52. As the gun recoils, the forearm will fill rather than escape from the shooter's hand.

The one-piece synthetic undercarriage 10 of the present invention allows for an additional desired feature. The butt stock may be formed to receive a removable recoil pad 64. The butt stock 14 should be formed with insert 54 for pin 68 attachment of the recoil pad 64. The upper, inner surface of the butt stock 14 can be formed with notch 58 to receive the pinion 66 of a removable recoil pad. Thus, the recoil pad is easily removable and replaceable for the personal preference of the shooter.

Although specific embodiments of the present invention have been illustrated and described in detail, it is to be expressly understood that the invention is not limited thereto. The above detailed description of the embodiment is provided for example only and should not be construed as constituting any limitation of the invention. Modifications will be obvious to those skilled in the art, and all modifications that do not depart from the spirit of the invention are intended to be included within the scope of the appended claims.

We claim:

1. A shotgun undercarriage, for use with a top receiver, barrel, fire control, carrier assembly, magazine assembly, and action system, the undercarriage comprising:

a. a butt stock adaptable for housing an action spring;

b. a bottom receiver, having at least one opening for mounting the fire control, the carrier assembly and the top receiver, the bottom receiver being formed integrally and unitary with the butt stock;

c. a bottom receiver, having an integrated bolt buffer, the integrated bolt buffer being formed integrally and unitary with the rearward portion of said bottom receiver; and d. a forearm comprising a magazine housing, the forearm being integrally formed and unitary with the bottom receiver;

e. the bottom receiver and forearm cooperatively forming at least one mounting surface capable of receiving the barrel and the top receiver.

2. The shotgun undercarriage of claim 1 wherein the butt stock, bottom receiver, and forearm comprise an integral and unitary molded material.

3. The shotgun undercarriage of claim 2 wherein the molded material is thermoplastic and is approximately twenty to fifty percent glass-filled polyamide nylon 6,6.

4. The shotgun undercarriage of claim 1 wherein the butt stock is formed with a grip having, an ambidextrous palm swell.

5. The shotgun undercarriage of claim 1 wherein the butt stock is formed with an elliptical butt end approximately 1¾ inches in width and approximately 5¼ inches in height.

6. The shotgun undercarriage of claim 1 wherein the bottom receiver has at least one upper opening for the top receiver, a first lower opening for the fire control, and a second lower opening for the carrier assembly, the second lower opening being located forwardly of the first lower opening.

7. The shotgun undercarriage of claim 1 wherein the magazine housing comprises the magazine tube to accommodate the magazine assembly.

8. The shotgun undercarriage of claim 1 wherein the magazine housing receives a magazine tube insert to accommodate the magazine assembly.

9. The shotgun undercarriage of claim 1 wherein the bottom receiver further comprises a lip formed to receive the top receiver.

10. The shotgun undercarriage of claim 1 wherein the forearm further comprises a guide ring pocket formed to receive a guide ring attached to the barrel.

11. A shotgun undercarriage comprising:

a butt stock having a rearward end and a forward end;

a bottom receiver having a rearward end and a forward end, the rearward end being integral and unitary with the forward end of the butt stock;

a bottom receiver having an integrated bolt buffer, the integrated bolt buffer being integral and unitary with the rearward end of said bottom receiver; and a forearm having a rearward end and a forward end, the rearward end being, integral and unitary with the forward end of the bottom receiver.

12. The shotgun undercarriage of claim 11 wherein the undercarriage is a molded material.

13. The shotgun undercarriage of claim 11 wherein the molded material is thermoplastic and is approximately twenty to fifty percent glass-filled polyamide nylon 6,6.

14. A shotgun comprising:

a barrel;

a top receiver attached to the barrel;

a magazine assembly;

a fire control assembly;

a carrier system;

an action system; and an undercarriage comprising:

(i) a butt stock having a forward end and a rearward end and the butt stock containing an axially extending action tube;

(ii) a bottom receiver having a forward end and a rearward end that is formed integral and unitary with the forward end of the butt stock, the bottom receiver having an integrated bolt buffer formed integral and unitary with the rearward portion of the said bottom receiver, the bottom receiver also having a bottom and two parallel and opposing longitudinally extending, sides that define a top support; and (iii) a forearm with a forward end and a rearward end that is formed integral and unitary with the forward end of the bottom receiver, the forearm also containing an axially extending magazine housing, wherein the undercarriage, barrel, top receiver, magazine assembly, fire control assembly, carrier system, and action system combine to form an autoloading shotgun capable of receiving, carrying and firing, cartridges.

15. The shotgun of claim 14 wherein the two parallel and opposing longitudinally extending sides of the bottom receiver further comprise longitudinally extending recesses formed on each of the parallel and opposing longitudinally extending sides of the bottom receiver.

16. The shotgun of claim 14 wherein the bottom of the bottom receiver further comprises: a fire control aperture formed in the bottom of the bottom receiver; and a loadwell opening formed in the bottom of the bottom receiver forward of the fire control aperture.

17. The shotgun of claim 14 further comprising:

a barrel with a rearward end and a forward end having a guide ring attached mesial to the rearward end and forward end; and a top receiver with a rearward end and a forward end, the forward end being attached to the rearward end of the barrel, the top receiver further including a bottom surface that is stepped downwardly from the top receiver to define opposing longitudinally extending, shoulders on each underside of the top receiver;

wherein the forearm has a top surface formed to receive the barrel and also comprises a guide ring pocket formed within the forward end of the forearm to receive the guide ring, wherein the bottom receiver has a lip to receive the rearward end of the top receiver and two longitudinally extending recesses along the parallel and opposing, longitudinally extending sides to receive the shoulders of the top receiver.

18. The shotgun of claim 14 further comprising: a recoil pad attached to the rearward end of the butt stock.

19. The shotgun of claim 14 wherein the forearm is forwardly tapered outwardly wherein the forward end of the forearm is wider than the rearward end of the forearm.

20. The shotgun of claim 14 wherein the wall thickness of the undercarriage is substantially uniform and approximately ¼ inch.

21. The shotgun of claim 14 wherein the forearm is formed with reinforced webbing.

22. The shotgun of claim 17 wherein the lip extends forwardly approximately ⅛ inch.

23. The shotgun of claim 14 wherein the shotgun weighs from approximately 6 to 9 pounds.

24. The shotgun of claim 23 wherein the shotgun weighs from approximately 7 to 7¼ pounds.

25. The shotgun of claim 14 wherein the magazine housing is a magazine tube to accommodate the magazine assembly.

26. The shotgun of claim 14 wherein the magazine housing receives a magazine tube insert to accommodate the magazine assembly.

27. A shotgun comprising:

a unitary undercarriage comprising:

(i) a butt stock having a forward end and a rearward end and the butt stock containing an axially extending action tube;

(ii) a bottom receiver having a forward end and a rearward end and an integrated bolt buffer that is formed integral and unitary with the forward end of the butt stock having a bottom and two parallel and opposing longitudinally extending sides each having a longitudinally extending recess, and also having a lip extending forwardly from the upper surface of the rearward end of the bottom receiver;

(iii) a forearm with a forward end and a rearward end that is formed integral and unitary with the forward end of the bottom receiver, the forearm containing an axially extending magazine tube, the forearm having a top surface defining channel and also having a guide ring pocket formed in the forward end;

a barrel with a rearward end and a forward end having a guide ring attached mesial to the rearward end and forward end whereby the barrel seats within the channel of the forearm and the guide ring rests within the guide ring pocket of the forearm;

a top receiver with a rearward end and a forward end, the forward end being integral and unitary with the rearward end of the barrel, the top receiver further including a bottom surface that is stepped downwardly from the top receiver to define opposing longitudinally extending shoulders along each underside of the top receiver whereby the shoulders seat within the longitudinally extending recesses of the bottom receiver and whereby the rearward end of the top receiver engages the lip of the bottom receiver; and a magazine assembly housed within the magazine tube;

a fire control assembly mounted within the bottom of the bottom receiver;

a carrier system mounted within the bottom of the bottom receiver forwardly of the fire control assembly;

an inertia-based action system; and a recoil pad attached to the rearward end of the butt stock, wherein the undercarriage, barrel, top receiver, magazine assembly, fire control assembly, carrier system, action system, and recoil pad combine and functionally cooperate to allow the shotgun to receive, carry and fire cartridges.

* * * * *